United States Patent [19]

Sudit

[11] Patent Number: 4,953,875

[45] Date of Patent: Sep. 4, 1990

[54] ELECTRICALLY SHORTING TARGET

[76] Inventor: Moises Sudit, 73 Forestbrook Ct., Getzville, N.Y. 14068

[21] Appl. No.: 383,587

[22] Filed: Jul. 24, 1989

[51] Int. Cl.[5] ..... F41J 5/04

[52] U.S. Cl. ..... 273/373

[58] Field of Search ..... 273/373

[56] References Cited

U.S. PATENT DOCUMENTS

| | | | |
|---|---|---|---|
| 2,749,125 | 6/1956 | Ream | 273/373 |
| 2,819,084 | 1/1958 | Brown et al. | 273/373 |
| 3,469,843 | 9/1969 | Hubbard | 273/373 |
| 4,240,640 | 12/1980 | LaMura | 273/373 |

*Primary Examiner*—Benjamin Layno

*Attorney, Agent, or Firm*—James J. Ralabate

[57] ABSTRACT

This target has a laminated structure of layered matrials. The first layer is an insulating foam which abuts the front face of a metallic foil front electrode. The front electrode has a thickness not exceeding 0.005 inches. Behind the front foil electrode is an intermediate insulating layer that electrically separates the front electrode from the rear electrode. This insulating layer should be thin enough to permit usage of the target with small caliber ammunition. The rear electrode is a substantially rigid metallic screen having a mesh not exceeding 50 mesh. Behind the rear electrode is an insulating layer having a thickness greater than that of the intermediate insulating layer.

16 Claims, 1 Drawing Sheet

ELECTRICALLY SHORTING TARGET

This invention relates to a target and more particularly to an improved electrically scoring target which records projectile hits.

BACKGROUND OF THE INVENTION

It is known in the art to use targets comprised of conductive layers or electrodes which are separated by an insulator. These electrodes are electrically connected subsequently by a metal projectile which penetrates the target during use and spans the insulation connecting the two electrodes for a split second and causing a short to occur thereby. Upon penetration of a projectile or bullet into the target layers, the metal bullet or projectile removes the insulator from its path and physically connects the electrodes causing an electrical short which is immediately indicated on appropriate display, monitor or the like.

There are U.S. patents which generally disclose systems and targets of this nature such as U.S. Pat. Nos. 2,819,084; 3,401,939; 3,454,277; and 4,240,640. In U.S. Pat. No. 2,819,084 (Brown) an electrically scoring target is disclosed constructed of two metallic screen electrodes separated by a rubber diaphragm. The electrodes of the Brown target are connected to a remote scoring indicator via a conductor wire which is connected to a screen. The scoring target by means of electrical relays will indicate whenever a short circuit is caused between Brown's metallic screens by the passage therethrough of a metal projectile. When using a target with two screens as in Brown, there is a high probability of causing a continuous short which would destroy the reusability of the target.

In La Mura U.S. Pat. No. 53,401,939 (La Mura I) a target is disclosed having two metal foil layers separated by a foam layer, and also having foam layers on the opposite face of each foil. The metal foil layers are displaced by the projectile and form a connection between these foil electrodes so that current can pass between them and be recorded by means of an external circuit. FIG. 4 of La Mura I illustrates a circuit means that is used in conventional systems of this type, and which is also applicable to the present invention. A potential problem encountered with the use of two metal foils is in using a foil as the back conductive layer there is poor reliability for low caliber bullets and airgun ammunition. The back insulating layer is so soft that it does not offer any resistance to the force of the projectile. This insulating layer does not contract to the maximum, restricting the usage of the target with only medium or large caliber projectiles. In this type two foil electrode target we found that when using airgun ammunition the failure of the target was continuous.

In La Mura U.S. Pat. No. 3,454,277 (La Mura II), like in Brown above discussed, a projectile shorting target with two wire screen electrodes is disclosed. La Mura II's target is comprised of two aluminum wire screens separated by an insulator material. A difficulty in utilizing this type target is the high probability of causing a continuous short resulting in the complete failure of the target. It is important in any target system of this type to have the ability to register small caliber projectiles and to accomplish this the intermediate insulating layer must be relatively thin. That is, the distance between the two electrodes must be small enough to be spanned by the small caliber projectile. When two electrode layers of wire are used together with a narrow insulator to separate them, the small wires of the front layer will puncture the thin insulating material and make a constant short with the back electrode layer. This problem can only be overcome by increasing the width of the intermediate insulating layer which then as noted above renders the target non-functional with small caliber such as airgun ammunition. Thus, La Mura II would either not function with small caliber ammunition or would be constantly shorted out because of contact by the front wire electrode with the back wire electrode.

In La Mura III, La Mura acknowledges that La Mura I and La Mura II are not satisfactory when he notes in column 1 of La Mura III when referring to his La Mura I and II, ". . . they possess important drawbacks and disadvantages, etc. . . . not only is the frequency of shorting between the electrodes after the traverse of the target by a projectile undesirably high necessitating the frequent electrical burning of the shorts or the discarding and replacement of the target, etc. . . . are of limited application and often unreliable and inconvenient to use and otherwise leave much to be desired." To correct these "frequency of shorting" problems presented by his earlier patents, La Mura III proposes the use of two resin coated aluminum wire screens separated by an insulation layer. There are two difficulties associated with using this type target. The first difficulty is identical with that noted above in reference to La Mura II. That is, a constant short will occur between the two wire screens almost immediately after shooting the target with medium or small caliber ammunition since the front electrode is a screen. This will render the target non-reusable. The second difficulty is caused by the coating of the wire screens. As indicated in La Mura III, this coating improves the reliability and durability of the target for large projectiles. However, La Mura III's target decreases the reliability almost to zero for small caliber projectiles like airgun ammunition and/or 0.22 caliber.

There is therefore a need for an electrically responsive target that is reliable, has a substantially long reusable life, and can be used with all size ammunition including small caliber projectiles.

SUMMARY OF THE INVENTION

It is therefore an object of this invention to provide an electrically responsive target that is devoid of the above noted disadvantages.

Another object of this invention is to provide an electrically responsive target that has an extended useful life.

A further object of this invention is to provide an electrically responsive target that has layers that all function cooperatively in order that the target can be used for small projectiles.

A yet further object of this invention is to provide an electrically responsive target that keeps continuous shorting at a minimum because of the unique structure and arrangement of its layers.

Still another object of this invention is to provide an electrically responsive target that maximizes reliability and permits an increased number of shots to be registered without a failure.

Yet another object of this invention is to provide an electrically responsive target that provides the required electric pulse to be of optimal magnitude for a registering or monitoring device.

These and other objects are accomplished in accordance with this invention by providing an electrically responsive target that has both extremely long life and has utility with all size projectiles including small caliber bullets and airgun ammunition. The term "projectile" as used throughout this disclosure and claims will encompass all size bullets, airgun ammunition or any other conductive structure driven into or through a target. "Bullet" and "projectile" will be used interchangeably throughout this disclosure. The arrangement and structure of each layer are important to the proper functioning of the target. For example, in the target of this invention the front electrode must be a metal foil and not a metal screen. This is because a metal screen once punctured by a projectile will have long screen strands at the projectile exit portion that will be pushed into contact with the back electrode. These strands often will be longer than the space between electrodes and therefore cause a continuous shorting reducing the reusability of the target. The foil exit portion will be much shorter and will not span the space between electrodes to cause a continuous short. Thus, the positioning of a metal foil as the front electrode is critical to the invention.

It is also critical to the present invention that the back electrode be a substantially rigid metal screen as opposed to a metal foil. The reason for this is that a foil back electrode is so soft and flexible that it does not offer any resistance to the force of the projectile. Because of this softness, the intermediate insulator layer does not contract to the maximum, restricting the usage to only medium or large caliber projectiles. In tests conducted a target using a foil back electrode exhibited continuous failure when airgun ammunition was used. That is because this small ammunition will not span the space between the two electrodes to contact each and cause the desired short to occur. The intermediate layer gives with the force of the small projectile and pushes the intermediate layer against the back electrode making insulating contact rather than conductive contact.

A third critical feature of this invention is the thickness and composition of the intermediate insulating layer. It must have such a composition and thickness that it will contract or compress upon projectile contact just enough to permit the projectile to contact both electrodes at the point of impact. Yet it must not be so thin that a constant short will occur after impact. It must have the necessary resiliency to compress sufficiently to cause conductive contact and the necessary resiliency to spring back around the projectile hole to its original thickness after penetration. An insulator foam of from about 0.125 to 0.25 inch thick must be used. It is preferred to use a thicknes of about 0.125 inches for maximum utility. The layer is identified throughout this disclosure as an "open cell" foam layer preferrably having about 1.7 lb/cu. ft. consistency and a compression factor of 70 (industrial code, 1770). Any kind of polymer foam having small or medium foam bubbles may be used such as polyurethane foams, polyvinyl chloride foams, polypropylene foam, or any other suitable fine celled material.

The front electrode is preferrably an aluminum 1145 alloy with a thickness of about 0.001 inch, however up to 0.005 inches thick can be used. The back electrode preferrably is a 20 mesh galvanized aluminum screen sometimes called a flyscreen. The back and front insulating layers are similar to the composition of intermediate insulating layer except that the thickness of the back and front layers can range from 0.125 to 0.5 inches thick. Preferrably a thickness in the front and intermediate of 0.25 inches is used for optimum results. The function of the front insulating layer is to prevent the projectile to destroy the aluminum foil, the function of the back insulating layer is to prevent the screen wire to puncture the cover. The back insulating layer is preferably thicker than the intermediate and front insulating layers.

While the electrodes are preferrably made of aluminum or an aluminum alloy, any suitable conductive material may be used. A source of electrical current is attached to the electrodes in order that appropriate electrical signals are generated upon shorting of the circuit. This system functions as earlier stated similar to the disclosure in U.S. Pat. No. 3,401,939 relative to their FIG. 4.

A cover is provided around the entire target to enhance its strength and to make it substantially waterproof. This cover is generally constructed of either cardboard or cloth.

The reliability of the target of the present invention with all size ammunition is evidenced from the below data on conducted tests. The following data shows the usage with all size bullets and the average number of bullets that a target successfully registered in one square inch:

| | | | |
|---|---|---|---|
| 1.77 caliber | 20 bullets | 9 mm caliber | 6 bullets |
| .22 and .32 | 12 bullets | 5.56 caliber | 8 bullets |
| .38 and .32 | 10 bullets | 7.62 caliber | 5 bullets |
| .357, .44 and .45 | 8 bullets | | |

These above figures were compiled with an expert shooter or marksman capable of clustering successive bullets in a 2 inch diameter circle. The life and function of the target would be substantially increased when used by an intermediate shooter (a 5 inch cluster or diameter) or a beginner shooter capable of attaining an 8 inch cluster or diameter circle.

DETAILED DESCRIPTION OF THE DRAWING AND PREFERRED EMBODIMENTS

Figure 1:
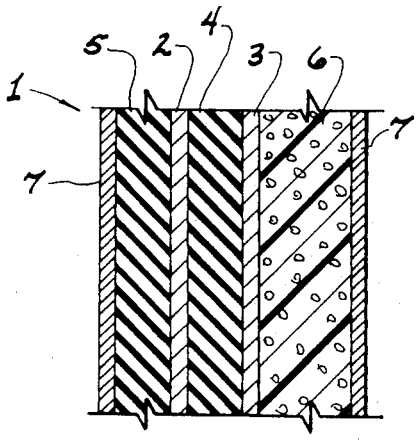
FIG. 1 is a cross sectional view of a portion of the electrically responsive layered target of this invention prior to projectile or bullet impact.

In FIG. 1 the layered electronically responsive target 1 of this invention is illustrated in a cross sectional view. The front electrode 2 is a foil of aluminum or other suitably conductive foil material. The preferred thickness of this foil is about 0.001 inches. The exit tail of this foil must be short enough to avoid contact with back electrode 3 after projectile penetration. As stated earlier if the front electrode was a screen, the target of the present invention would not function properly since the exit tail left after projectile penetration would be longer than the space between the electrodes and would cause a continuing short adversely affecting the reusability of the target. Superimposed between front foil electrode 2 and back screen electrode 3 is an intermediate insulating layer 4 that keeps the electrodes 2 and 3 electrically insulated from each other during non-use of the target. The intermediate insulating layer 4 cannot exceed 0.25 inches thick and preferrably is about 0.125 inches thick when used in a target having a total thickness of from about 0.375 to 0.75 inches and with a front foil electrode 2 of about 0.001–0.005 inch thick and a preferred 15–25 mesh galvanized aluminum screen back electrode which is 0.005 inches thick. The intermediate insulating layer 4 must have a thickness and resiliency when used with a back screen electrode that will permit it to contract to substantially its fullest extent and yet be thin enough to cause electrode contact when a small caliber bullet or projectile is used. The back electrode 3 must have an ideal mixture of stiffness and flexibility properties, and be strong enough to offer enough resistance to the force of the projectile causing the insulating layer 4 to contract to near maximum. This is important for use of small ammunition as earlier noted. In front of front electrode 2 is a front insulating layer 5 and is needed to protect the adjacent front electrode 2 from complete disintegration when hit by a projectile. This front insulating layer 5 is preferrably an open cell foam. It can be from 0.125 to 0.5 thick but preferrably is about 0.125 inches thick. Without front insulating layer 5 the front electrode 2 would be substantially destroyed upon use. The integrity of front electrode 2 is critical to proper functioning of the invention, if the foil electrode 2 is too thick (exceeds 0.005 inches), it will be destroyed much easier since it offers more resistance to the force of the projectile. On the other hand, a foil that is too thin, about 0.0005, will not have the strength required to allow the front insulator layer 5 to keep it together and to allow future electric contacts. The intermediate insulating layer 4 has a preferred thickness of about 0.10 to 0.20 inches which was carefully selected to allow a whole range of calibers to be registered. If a thicker foam layer 4 was used, the airgun ammunition or other small ammunition would fail to register because the thickness of the layer 4 would exceed the maximum thickness or diameter of the small projectile. The galvanized aluminum screen back electrode 3 is preferrably about 15–25 mesh, but could range from 15 to 50 mesh. The selection of this type electrode 3 is important since the small wire comprising the screen gives a high probability of always making contact even when a bullet crosses exactly through the same hole twice. Also the ideal stiffness and flexibility of the screen electrode 3 provides support for intermediate insulating layer 4 and allows it to contract to the extent required upon bullet impact. So while a screen electrode could not be used in this invention as the front electrode 2 it is ideal for the back electrode 3. The back electrode 3 has an open cell foam rear insulating layer 6. This final or rear insulating layer 6 is made thicker than the other layers 4 and 5 in order to enhance the spring back effect of the target. It is important that the target insulating layers 4, 5 and 6 return to the extent possible to their original configuration. A cover 7 encloses the target 1 to protect it in shipping and keeping moisture out of the interior of the target. In any electrically driven structure, it is important to control the amount of moisture internally. Cover 7 can be constructed of cardboard, paper, cloth or plastic, or mixtures thereof.

Figure 2:
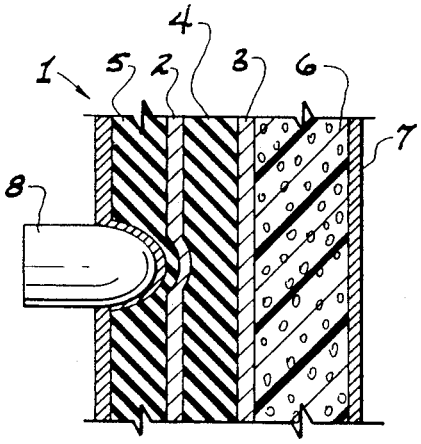
FIG. 2 is a cross sectional view of a portion of the electrically responsive layered target of this invention as the bullet initially impacts the target.
Figure 3:
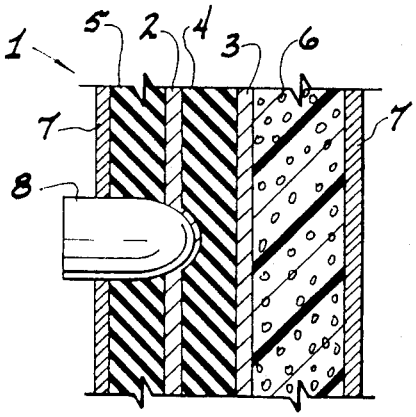
FIG. 3 is a cross sectional view of a portion of the electrically responsive layered target of this invention as the bullet makes initial contact with the foil front electrode.
Figure 4:
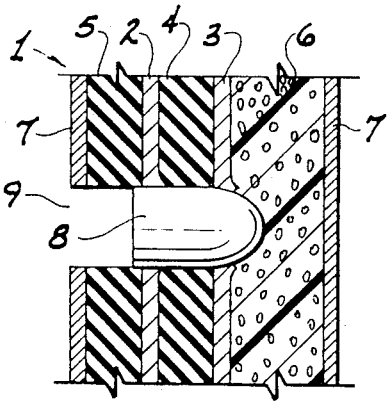
FIG. 4 is a cross sectional view of a portion of the electrically responsive layered target of this invention as the conductive bullet contacts both the front and back electrode to complete the circuit and short out the target.
Figure 5:
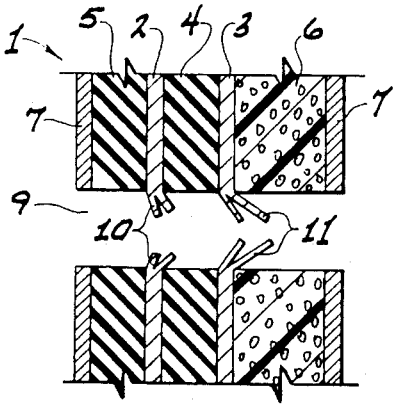
FIG. 5 is a cross sectional view of a portion of the electrically responsive layered target of this invention after the bullet passed through the entire target thickness.
Figure 6:
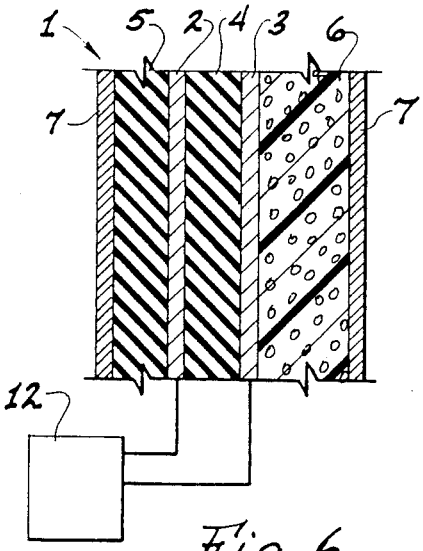
FIG. 6 is a cross sectional view of the target of this invention with the electrical scoring and monitoring circuit connected thereto.

In FIG. 2 a projectile 8 makes initial contact with target 1 and depresses cover 7 inwardly toward front electrode 2. Front electrode 2 begins to become deformed inwardly toward back electrode 3. The force of projectile 8 causes layers 7, 5, 2 and 4 to be inwardly deformed or bent. In FIG. 3, the projectile 8 is shown piercing cover 7 and front insulating layer 5. Shorting at this point has not occurred since projectile 8 has not yet established connection between front electrode 2 and rear electrode 3. In FIG. 4 contact is made by the conductive projectile 8 with both electrodes 2 and 3 thereby shorting out the circuit and registering this on a monitor or other visual or sound means electrically connected to the target 1 as earlier described and similar to the description of FIG. 4 of U.S. Pat. No. 3,454,277. In FIG. 5 the target 1 is shown after the bullet 8 exits the target leaving a bullet hole 9 but maintaining electrodes 2 and 3 electrically separated for further use. Note that the exit tail 10 of front foil electrode 2 is substantially shorter than the exit tail 11 of rear screen electrode 3. Since tails 10 and 11 remain supported on electrodes 2 and 3 respectively, a second projectile or bullet shot through the exact hole 9 will again short by connecting tails 10 and 11 for an instant. Unlikely as it is, the utility of this target is emphasized by the fact that even a hit at the same location on the target (hole 9) will register by shorting again. In FIG. 6, target 1 is shown connected to the indicators and power supply 12 of the system used with the target of this invention. The target functions as follows: Two wires are attached to the two conductive layers. Electricity is conducted from a power source to the two electrodes through the wires. Since electrodes are isolated, no change in electrode flow will register. When a projectile crosses the target, a short signal is registered between electrodes for a split second. The machine then analyzes and gives audio-visual feedback to the user.

While electrically scoring targets have been known the present target provides a reusable target with an extended life that can be used even with small caliber ammunition. The present target has a laminated structure of layers sequentially abutting each other. First there is a front insulating layer, then a foil electrode, then an intermediate insulating layer, then a screen electrode, then a back insulating layer. The insulating layers are made of open cell foams having a density of about 1.7 lb./cu. ft. The intermediate insulating layer must have a thickness and density that permits substantially maximum compression when the force of a projectile hits and passes therethrough. The rear electrode has a tensil strength at least ten times greater than the front foil electrode.

The dimensions used for each of the electrodes and layers of the present invention are based upon a target having a total thickness of 0.506. It should be understood however that if a larger or smaller target (in terms of thickness) is desired, these dimensions are enlarged or reduced in proportion to the dimensions herein described for a 0.506 inch thick target. For example, if the pesent target is 1 inch thick and uses a 0.001 inch aluminum foil electrode, a 2 inch thick target would use a 0.002 inch aluminum foil electrode, etc. with the other dimensions.

The preferred and optimumly preferred embodiments of the present invention have been described herein and shown in the accompanying drawing to illustrate the underlying principles of the invention, but it is to be understood that numerous modifications and ramifications may be made without departing from the spirit and scope of this invention.

What is claimed is:

1. An electrically responsive target for registering projectile contact which comprises sequentially abutting each other a front electrode, an intermediate insulating layer, and a rear electrode, said front electrode being a metallic foil having a thickness smaller than that of said intermediate insulating layer, said intermediate insulating layer having a thickness and density that permits substantially maximum compression when it is contacted and penetrated by a projectile, said rear electrode is a metallic screen having a tensil strength greater than that of said front electrode.

2. The target of claim 1 wherein said front electrode has an insulating layer abutting its front face and said intermediate insulating layer abutting its back face.

3. The target of claim 1 wherein said rear electrode has said intermediate insulating layer abutting its front face and having an insulating layer abutting its back face.

4. The target of claim 1 wherein said front and rear electrodes are comprised of a conductive aluminum containing composition.

5. The target of claim 1 wherein said rear electrode comprises a metallic wire screen having a mesh up to about 50.

6. An electrically responsive target for registering projectile contact which comprises sequentially abutting each other a front insulating layer, a front electrode, an intermediate insulating layer, a rear electrode, and a back insulating layer, said front electrode being a metallic foil having a thickness of at least 0.005 inches thick, said intermediate layer being an open cell foam insulator having a thickness of at least 0.10 inches thick, and wherein said rear electrode is a metallic wire screen having a mesh of about 15 to about 50 and having means to electrically connect said target to an electrical circuit.

7. The target of claim 6 wherein said front electrode is an aluminum alloy having a thickness of from about 0.0005 to about 0.005 inches.

8. The target of claim 6 wherein said intermediate insulating layer has a thickness of from about 0.10 to about 0.20 inches.

9. The target of claim 6 wherein said intermediate insulating layer has a resiliency that will permit it to return substantially to its original thickness after a projectile passes therethrough.

10. An electrically responsive target of a laminated construction comprising a front electrode, a rear electrode, and an intermediate insulating layer, said intermediate insulating layer disposed between said electrodes to provide electrical insulation therebetween, said front electrode being and aluminum alloy foil having a thickness of about 0.001 inches to about 0.005 inches, said rear electrode is a galvanized aluminum screen having a mesh of about 15 to 50 mesh, said intermediate insulating layer being an open cell foam layer having a thickness of from about 0.1 to about 0.2 inches, said front electrode having an open cell foam insulating layer abutting its front face, said rear electrode having a back open cell foam insulating layer abutting its rear face, said electrodes having connection means to an electrical circuit and to a source of electrical energy.

11. The target of claim 10 wherein said front electrode has a thickness of about 0.001 inches.

12. The target of claim 10 wherein said intermediate insulating layer has thickness of about 0.125 inches.

13. The target of claim 10 wherein said rear electrode has a mesh of about 20.

14. The target of claim 10 wherein the entire target has a substantially waterproof covering to minimize the amount of mositure internally thereto.

15. The target of claim 10 wherein each open cell foam layer has a resiliency that will permit the layer to return except for a projectile hole, to substantially their original thickness after projectile pass-through.

16. The target of claim 10 wherein said back open cell foam insulating layer has a thickness of about 0.025 inches.

* * * * *